US009506713B2

(12) United States Patent
Frazier

(10) Patent No.: US 9,506,713 B2
(45) Date of Patent: Nov. 29, 2016

(54) FIREARM COVER FOR ATTACHMENT TO A FIREARM WITH A SCOPE MOUNTED THERETO

(71) Applicant: David Samuel Frazier, Gray, GA (US)
(72) Inventor: David Samuel Frazier, Gray, GA (US)

( * ) Notice: Subject to any disclaimer, the term of this patent is extended or adjusted under 35 U.S.C. 154(b) by 54 days.
(21) Appl. No.: 14/293,706
(22) Filed: Jun. 2, 2014
(65) Prior Publication Data
US 2015/0345888 A1 Dec. 3, 2015
(51) Int. Cl.
*F41A 35/02* (2006.01)
*B65D 85/00* (2006.01)
(52) U.S. Cl.
CPC ..... *F41A 35/02* (2013.01); *Y10T 29/49828* (2015.01)
(58) Field of Classification Search
CPC ..... F41A 35/04; F41A 35/02; F41A 35/00; B65D 85/00
USPC ..... 42/96, 85; 206/317; 224/913
See application file for complete search history.

(56) References Cited

U.S. PATENT DOCUMENTS

| | | | | | |
|---|---|---|---|---|---|
| 2,364,340 | A | | 12/1944 | Bogg, Jr. | |
| 2,599,689 | A | | 6/1952 | Brelsford | |
| 2,872,960 | A | * | 2/1959 | Kolpin | F41C 33/06 206/317 |
| 3,701,371 | A | | 10/1972 | Stackhouse | |
| 4,433,500 | A | * | 2/1984 | Kunevicius | F41A 35/02 42/96 |
| 4,664,987 | A | | 5/1987 | Isenberg | |
| 4,858,361 | A | * | 8/1989 | White | F41A 35/02 206/317 |
| 4,860,479 | A | * | 8/1989 | Easter | F41A 35/02 206/317 |
| 5,048,217 | A | * | 9/1991 | Easter | F41A 35/02 42/96 |
| 5,678,344 | A | | 10/1997 | Jones et al. | |
| 5,893,502 | A | * | 4/1999 | Redzisz | A01K 97/00 206/317 |
| 6,119,388 | A | * | 9/2000 | Jones | F41A 35/02 42/96 |
| 6,256,922 | B1 | * | 7/2001 | Jones | F41C 33/06 42/96 |
| 7,185,607 | B1 | * | 3/2007 | Pearson | F41C 33/06 42/96 |
| 7,559,168 | B2 | * | 7/2009 | Wisecup | F41G 1/383 42/96 |
| 7,905,350 | B2 | * | 3/2011 | Wood | F41C 33/06 206/315.11 |
| D644,295 | S | | 8/2011 | Obradovich | |
| 8,327,572 | B2 | | 12/2012 | Boggan et al. | |
| 8,375,617 | B2 | | 2/2013 | Brensinger | |
| 2008/0110076 | A1 | * | 5/2008 | Bennett | F41C 33/06 42/96 |
| 2013/0153450 | A1 | * | 6/2013 | Travis | F41C 33/06 206/317 |

OTHER PUBLICATIONS

Wkyduckslayer, "Gunbrella for Sale", http://www.kentuckyhunting.net/forums/showthread.php?25853-Gunbrella-For-Sale, Mar. 28, 2006.

1761TONY1761, "Gunbrella Warerproof Gun Cover", http://www.ebay.com/itm/Gunbrella-Warerproof-Gun-Cover-/161144667543?nma=true&si=HCLet1%252BL%252B97noB%252Biv25%252BH7JZ9D0%253D&orig_cvip=true&rt=nc&_trksid=p2047675.I2557, Nov. 12, 2013.

Carolee Boyles, "Gunbrella Wraps Long Guns in Camo, H&R 1871 Chambers .22 LR, Otis Creates Nipple Pen", www.highbeam.com/doc/1P3-40719445.html, Apr. 1, 1999.

* cited by examiner

*Primary Examiner* — Jonathan C Weber
(74) *Attorney, Agent, or Firm* — Sutherland Asbill & Brennan LLP

(57) ABSTRACT

A firearm cover for attachment to a firearm with a scope mounted thereto is disclosed herein. The firearm cover may include a barrel cover, a stock cover attached to the barrel cover, and a rotatable hood attached to the stock cover. The rotatable hood may include a first configuration disposed about the scope and a second configuration rotated away from the scope.

8 Claims, 6 Drawing Sheets

FIREARM COVER FOR ATTACHMENT TO A FIREARM WITH A SCOPE MOUNTED THERETO

FIELD

The disclosure generally relates to a firearm and more particularly relates to a firearm cover for attachment to a firearm with a scope mounted thereto.

BACKGROUND

Sportsmen shoot during hunting season under conditions of rain, shine, snow, sleet, fog, dirt, and dust. Such condition may damage the firearm and/or may render the scope unusable. To address this problem, various firearm covers have been employed to encase the firearm and the scope. However, many of the firearm covers are limited because they do not permit use of the scope or discharge of the firearm while the firearm is enclosed in such a casing, or because they do not adequately shield the action of the firearm or its scope from falling or blowing precipitation and dust.

SUMMARY

Some or all of the above needs and/or problems may be addressed by certain embodiments of a firearm cover for attachment to a firearm with a scope mounted thereto. The firearm cover may include a barrel cover, a stock cover attached to the barrel cover, and a rotatable hood attached to the stock cover. The rotatable hood may include a first configuration disposed about the scope and a second configuration rotated away from the scope.

Other features and aspects of the firearm cover will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
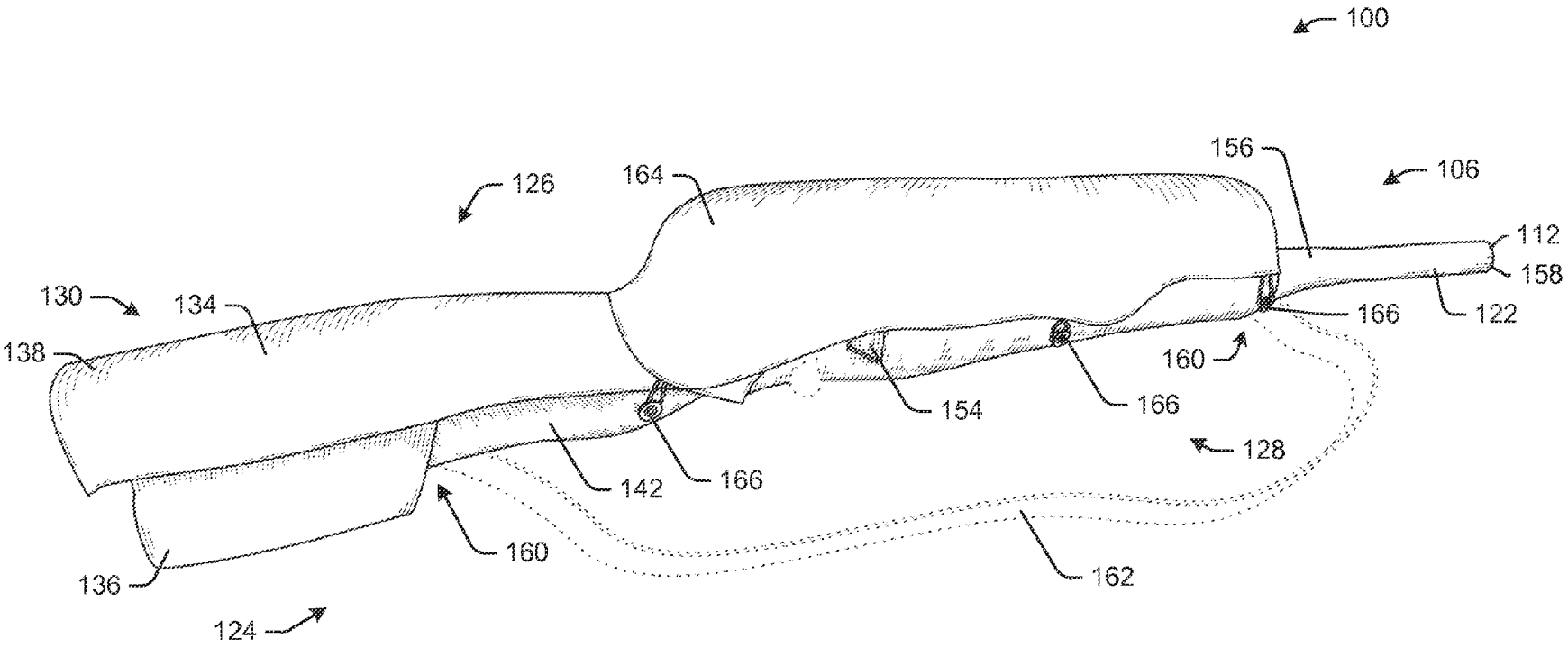
FIG. 1 schematically depicts a firearm cover in accordance with one or more embodiments of the disclosure.

Described below are embodiments of a firearm cover for attachment to a firearm with a scope mounted thereto. Methods of installing the firearm cover are also disclosed. In some instances, the firearm may be a conventional bolt-action rifle. In other instances, the firearm may be an M-16 style rifle, an AR-15 style rifle, an AR-10 style rifle, an M-4 style rifle, a shotgun, or a handgun, among others. Any firearm with a scope mounted thereto may be used herein. The firearm cover may be configured to protect the firearm and the scope from the surrounding environment. For example, the firearm cover may be waterproof to provide a weather barrier about the firearm and the scope. The firearm cover may protect the firearm from contaminants, such as rain, snow, dirt, etc. In some instances, the firearm may be discharged (or fired) when the firearm cover is attached to the firearm. Similarly, the scope may be used to aim the firearm when the firearm cover is attached to the firearm. In this manner, the firearm cover may protect the firearm from the environment but may not limit the operation of the firearm.

The firearm may include a stock, a barrel, an action assembly (such as a bolt-action assembly), a trigger assembly, a muzzle end, and a magazine port. The stock may include a butt and a fore-end. In addition, as noted above, a scope may be attached to the firearm as well. The firearm may include additional components, or certain components may be omitted.

The firearm cover may include a barrel cover and a stock cover. The barrel cover may be configured to cover the barrel of the firearm, and the stock cover may be configured to cover the stock of the firearm. In some instances, the barrel cover and the stock cover may be a single unitary piece. In other instances, the barrel cover and the stock cover may be separate components. The separate components may be releasable attached together.

The stock cover may include a butt cover and a fore-end cover. The butt cover may be configured to cover the butt of the stock, and the fore-end cover may be configured to cover the fore-end of the stock. The butt cover may include a number of butt flaps having an open configuration and a closed configuration. The open configuration may enable a user to insert and/or remove the butt of the firearm from the butt cover, and the closed configuration may enable a user to secure the butt of the firearm within the butt cover. For example, the butt flaps may be adapted to be fastened together by one or more fasteners when in the closed configuration.

In some instance, an outer butt flap may be downward facing when in the closed configuration. The downward facing outer butt flap may prevent water or other contaminants from breaching the firearm cover. In certain embodiments, the butt flaps may include a rear flap, a top flap, a first bottom flap, and a second bottom flap. The rear flap, the top flap, the first bottom flap, and the second bottom flap may be folded together about the butt of the firearm in the second configuration. In some instances, the top flap may comprise the outer most flap and may face downward when in the second configuration. In addition, the second bottom flap may include a fastening strap configured to be attached to the fore-end cover to secure the firearm cover to the firearm.

The fore-end cover may include at least two fore-end flaps having an open configuration and a closed configuration. The open configuration may enable a user to insert and/or remove the fore-end of the firearm from the fore-end cover, and the closed configuration may enable a user to secure the fore-end of the firearm within the fore-end cover. For example, the at least two fore-end flaps may be adapted to be fastened together by one or more fasteners when in the closed configuration.

In some instances, an outer fore-end flap of the at least two fore-end flaps may be downward facing when in the closed configuration. The downward facing outer fore-end flap advantageously may prevent water (e.g., falling rain, sleet, or snow) or other contaminants from breaching the firearm cover. The fore-end cover may include a cutout portion to accommodate the action assembly and the trigger assembly of the firearm. In this manner, the action assembly and the trigger assembly may be operational to fire the firearm when the firearm cover is disposed about the firearm. To further secure the firearm cover to the firearm, the fore-end cover may include a cutout strap extending across the cutout portion and beneath the scope.

The barrel cover may include a tubular member extending from the stock cover to the muzzle of the firearm. To enable the firearm to be discharged when the firearm cover is attached to the firearm, the barrel cover may include an opening at the muzzle of the firearm. Moreover, the firearm cover may include one or more openings for the attachment of a sling.

The firearm cover may include a rotatable hood attached to the stock cover. The rotatable hood may include a first configuration disposed about the scope and a second configuration rotated away from the scope. The rotatable hood may completely cover the scope in the first configuration. In some instances, the rotatable hood advantageously may face downward in the first configuration to prevent water or other contaminants from breaching the firearm cover. When the rotatable hood is rotated to the second configuration, the scope may be exposed and operational for aiming. That is, in some instances, the scope may be used for its intended purpose when the firearm cover is attached to the firearm, while in other instances, the scope may be protected from the environment. To secure the rotatable hood in the first configuration, the firearm cover may include at least one coupling.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-6 schematically depict a firearm cover 100 that can be attached to a firearm 102 in accordance with one or more embodiments of the disclosure. The firearm 102 may be a conventional firearm. By way of example, the firearm 102 may be any number of firearms, such as, but not limited to, a bolt-action rifle, a shotgun, an M-16 style rifle, an AR-15 style rifle, an AR-10 style rifle, an M-4 style rifle, or the like. Moreover, the firearm 102 may be a handgun or the like. In certain embodiments, the firearm 102 may include, among other things, a stock 104, a barrel 106, an action assembly 108 (such as a bolt-action assembly), a trigger assembly 110, a muzzle end 112, and a magazine port 114. The stock 104 may include a butt 116 and a fore-end 118. Moreover, a scope 120 may be attached to the firearm 102.

The firearm cover 100 may include a barrel cover 122 and a stock cover 124. The barrel cover 122 may be configured to cover the barrel 106 of the firearm 102, and the stock cover 124 may be configured to cover the stock 104 of the firearm 102. In some instances, the barrel cover 122 and the stock cover 124 may be a single unitary piece of material. The firearm cover 100 may comprise a waterproof or water-resistant material. In one embodiment, the material is a natural or synthetic fabric, which has been laminated to or coated with a waterproofing material such as rubber, polyvinyl chloride, polyurethane, silicone elastomer, or fluoropolymer. Any material may be used herein.

The stock cover 124 may include a butt cover 126 and a fore-end cover 128. The butt cover 126 may be configured to cover the butt 116 of the stock 104, and the fore-end cover 128 may be configured to cover the fore-end 118 of the stock 104. In some instances, the butt cover 126 and the fore-end cover 128 may comprise a single unitary piece of material extending from the barrel 106 of the firearm 102 to the butt 116 of the stock 104.

Figure 2:
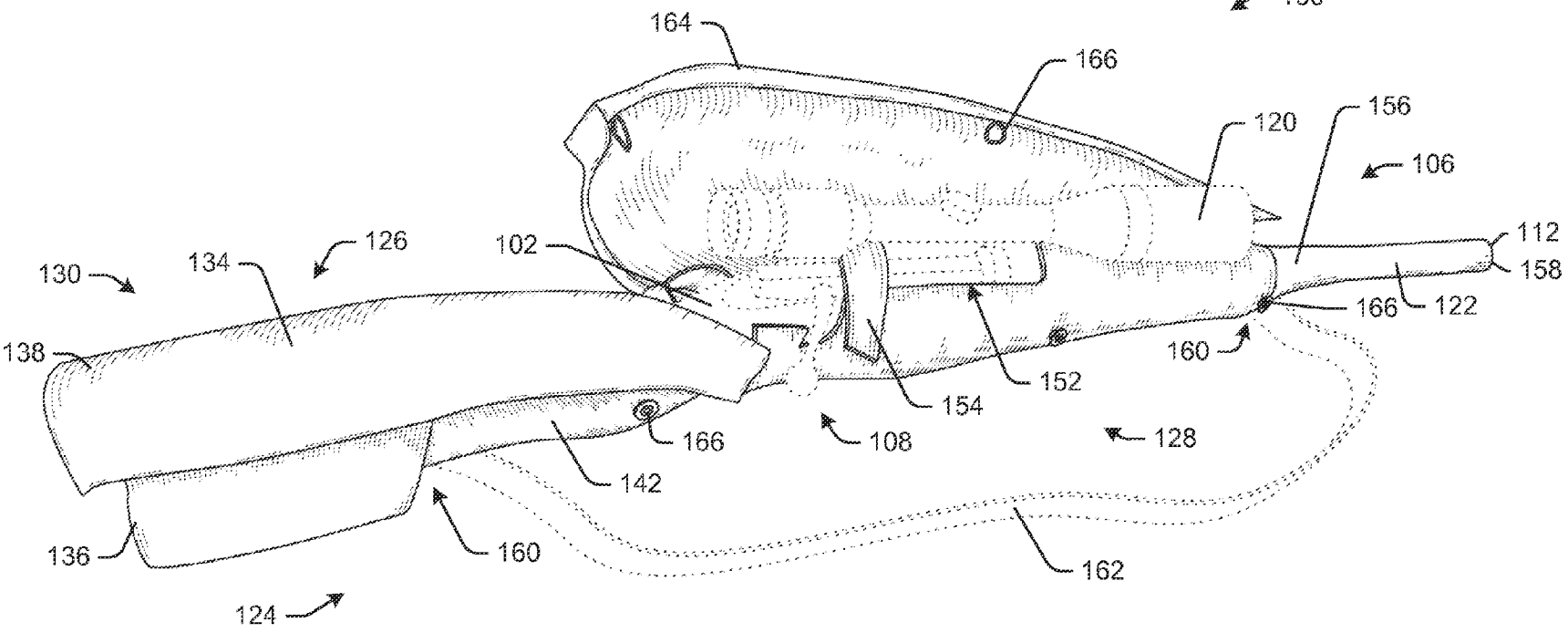
FIG. 2 schematically depicts a firearm cover in accordance with one or more embodiments of the disclosure.
Figure 3:
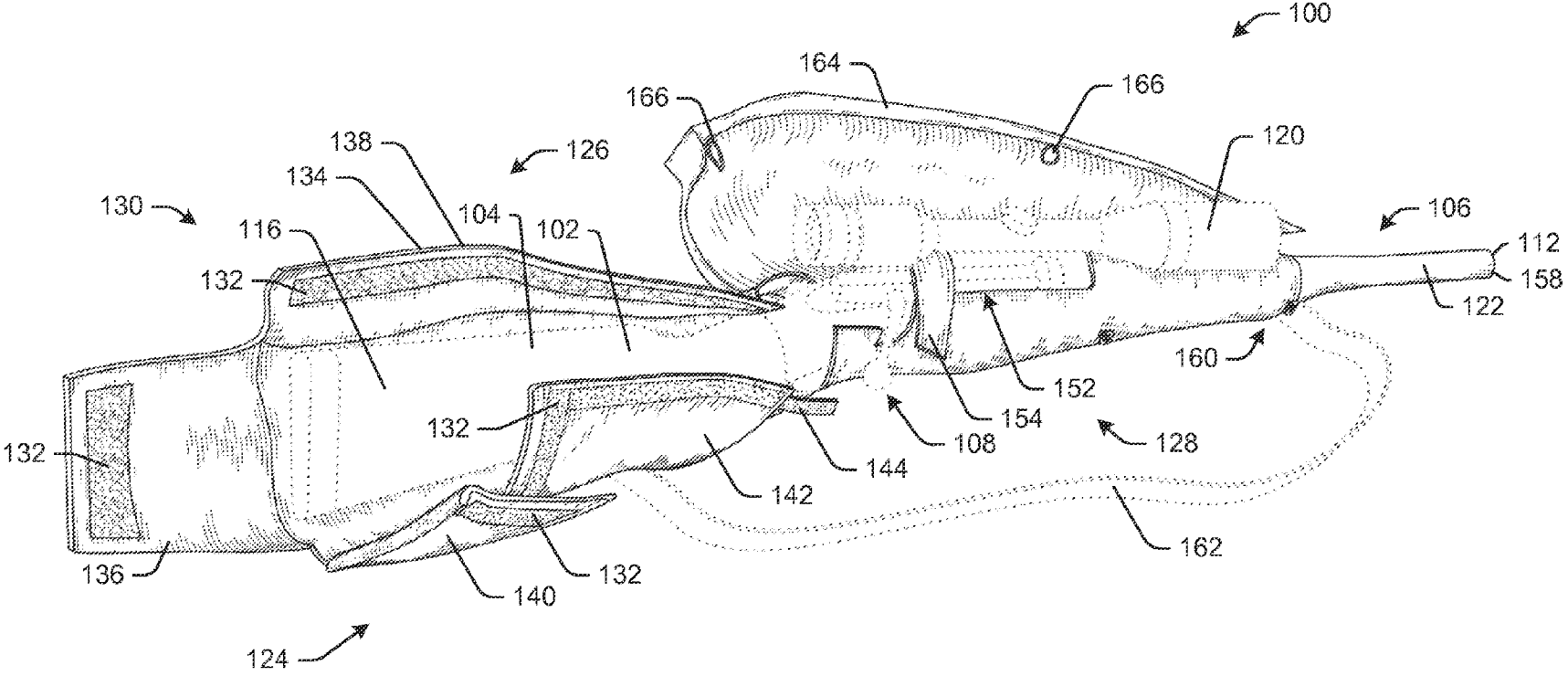
FIG. 3 schematically depicts a firearm cover in accordance with one or more embodiments of the disclosure.
Figure 4:
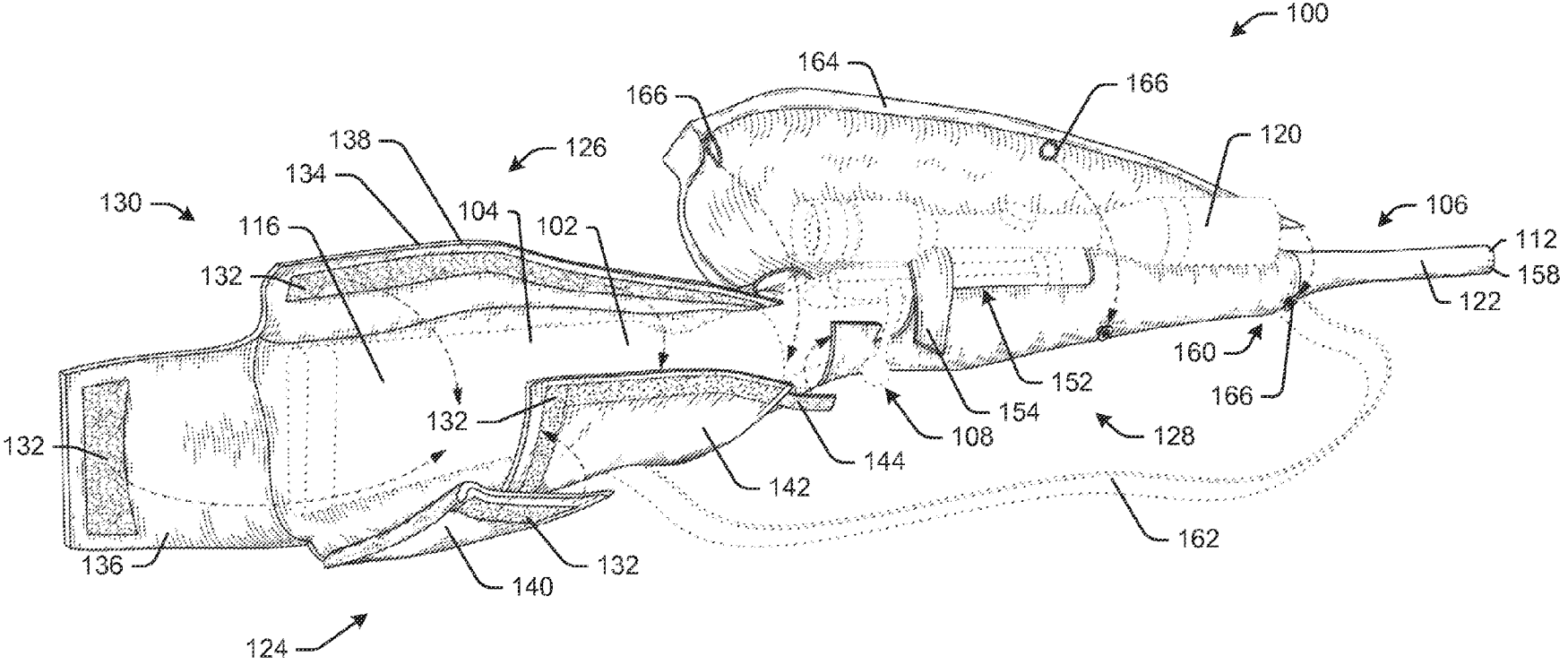
FIG. 4 schematically depicts a firearm cover in accordance with one or more embodiments of the disclosure.

The butt cover 126 may include a number of butt flaps 130 having an open configuration (as depicted in FIGS. 3 and 4) and a closed configuration (as depicted in FIGS. 1, 2, 5, and 6). The open configuration may enable a user to insert and/or remove the butt 116 of the firearm 102 from the butt cover 126, and the closed configuration may enable a user to secure the butt 116 of the firearm 102 within the butt cover 126. For example, the butt flaps 130 may be adapted to be fastened together by one or more fasteners 132 when in the closed configuration. In some instances, the one or more fasteners 132 may be hook-and-loop fasteners (known commercially as VELCRO®) or the like. Other types of fasteners may be used, including zippers, buttons, magnetic fasteners, etc.

In some instances, an outer butt flap 134 may be downward facing when in the closed configuration. The downward facing outer butt flap 134 may prevent water or other contaminants from breaching the firearm cover 100. In certain embodiments, the butt flaps 130 may include a rear flap 136, a top flap 138, a first bottom flap 140, and a second bottom flap 142. The rear flap 136, the top flap 138, the first bottom flap 140, and the second bottom flap 142 may be folded together about the butt 116 of the firearm 102 in the second configuration to encase the butt 116 of the firearm 102. In some instances, the top flap 138 may comprise the outer butt flap 134 and may face downward when in the second configuration. The downward facing outer top flap 138 may prevent water or other contaminants from breaching the firearm cover 100. In addition, the second bottom flap 142 may include a fastening strap 144 configured to be attached to the fore-end cover 128 to secure the firearm cover 100 to the firearm 102. The fastening strap 144 may ensure that the firearm cover 100 fits snugly against the firearm 102. In some instances, the fastening strap 144 may be a hook-and-loop fastener, a button, a zipper, a magnetic fastener, or the like. Any fastening means may be used herein.

Figure 5:
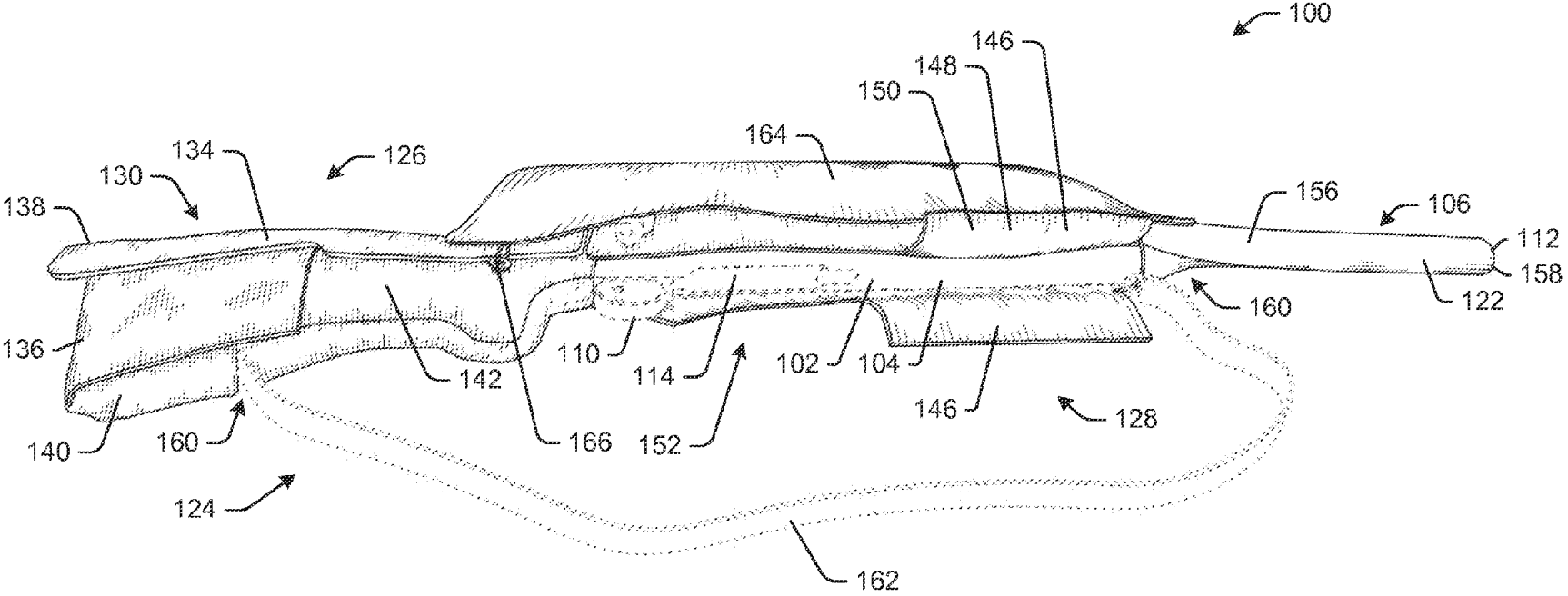
FIG. 5 schematically depicts a firearm cover in accordance with one or more embodiments of the disclosure.
Figure 6:
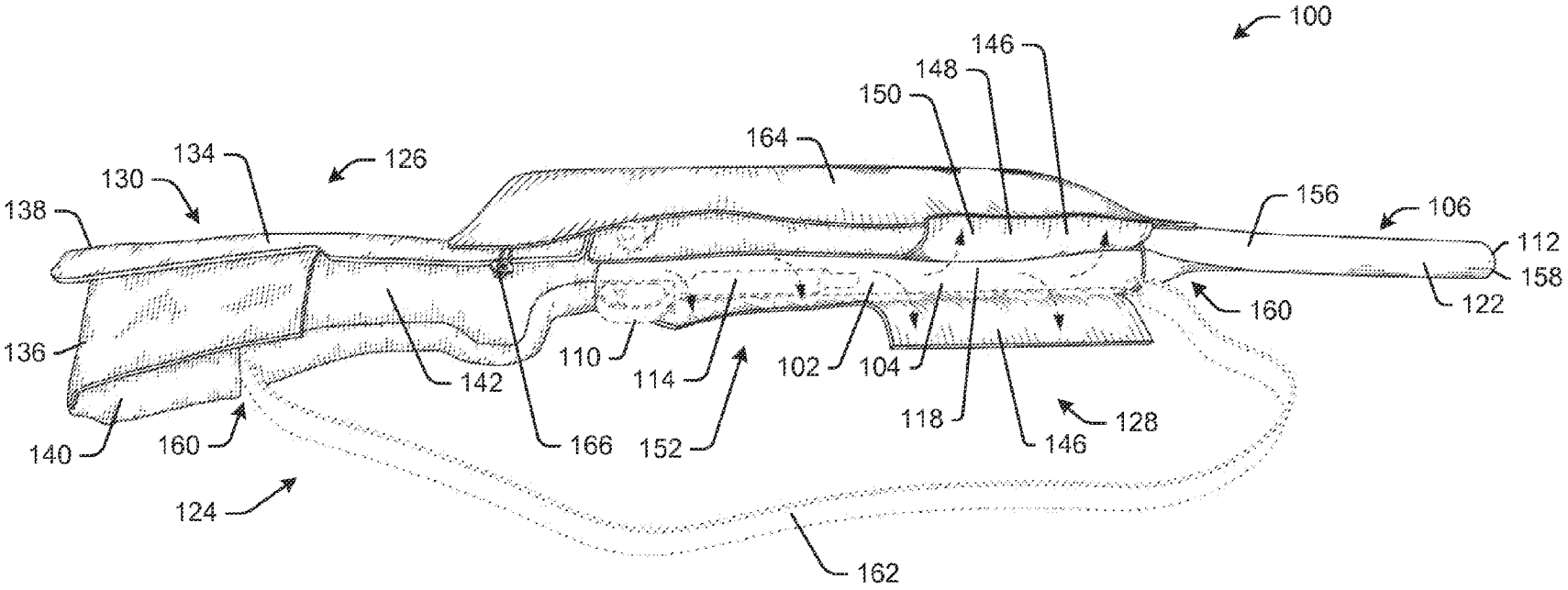
FIG. 6 schematically depicts a firearm cover in accordance with one or more embodiments of the disclosure.

The fore-end cover 128 may include at least two fore-end flaps 146 having an open configuration (as depicted in FIGS. 5 and 6) and a closed configuration (as depicted in FIGS. 1-4). The open configuration may enable a user to insert and/or remove the fore-end 118 of the firearm 102 from the fore-end cover 128, and the closed configuration may enable a user to secure the fore-end 118 of the firearm 102 within the fore-end cover 128. For example, the at least two fore-end flaps 146 may be adapted to be fastened together by one or more fasteners 148 when in the closed configuration.

In some instances, the fasteners 148 may include hook-and-loop fasteners, buttons, zippers, magnetic fasteners, or the like. Any fastening means may be used herein.

In some instances, an outer fore-end flap 150 of the at least two fore-end flaps 146 may be downward facing when in the closed configuration. The downward facing outer fore-end flap 150 may prevent water or other contaminants from breaching the firearm cover 100. The fore-end cover 128 may include a cutout portion 152 to accommodate, among other things, the action assembly 108 and the trigger assembly 110 of the firearm 102. The cutout portion 152 may also accommodate access to the magazine port 114, if present, to enable a magazine to be inserted into the firearm 102. In this manner, the action assembly 108 and the trigger assembly 110 may be operational to fire the firearm 102 when the firearm cover 100 is disposed about the firearm 102. To further secure the firearm cover 100 to the firearm 102, the fore-end cover 128 may include a cutout strap 154 extending across the cutout portion 152 and beneath the scope 120.

The barrel cover 122 may include a tubular member 156 extending from the stock cover 124 to the muzzle end 112 of the firearm 102. To enable the firearm 102 to be discharged when the firearm cover 100 is attached to the firearm 102, the barrel cover 122 may include an opening 158 at the muzzle end 112 of the firearm 102. The opening 158 may enable a projectile to exit the barrel 106 when the firearm 102 is discharged. Moreover, the firearm cover 100 may include one or more openings 160 for the attachment of a sling 162 or the like.

The firearm cover 100 may include a rotatable hood 164 attached to the stock cover 124. The rotatable hood 164 may include a first configuration disposed about the scope 120 (as depicted in FIGS. 1, 5, and 6) and a second configuration rotated away from the scope 120 (as depicted in FIGS. 2, 3, and 4). The rotatable hood 164 may completely cover the scope 120 in the first configuration. In some instances, the rotatable hood 164 may face downward in the first configuration to prevent water or other contaminants from breaching the firearm cover 100 and damaging the scope 120. When the rotatable hood 164 is rotated to the second configuration, the scope 120 may be exposed and operational for aiming. That is, in some instances, the scope 120 may be used for its intended purpose when the firearm cover 100 is attached to the firearm 102. In other instances, the scope 120 may be protected from the environment. To secure the rotatable hood 164 in the first configuration, the firearm cover 100 may include at least one coupling 166. The coupling 166 may include a loop and latch mechanism, a button, a magnetic fastener, or the like. In a preferred embodiment, the coupling is a magnetic or other fastener that can be disengaged very quickly and quietly, so that when a hunter is using the cover, the hunter advantageously can quickly and silently flip open the hood to uncover the scope without alerting the target animal. Any device capable of maintaining the rotatable hood 164 in the first configuration may be used herein.

The firearm cover 100 may be configured to protect the firearm 102 and the scope 120 from the surrounding environment. For example, the firearm cover 100 may be waterproof to provide a weather barrier about the firearm 102 and the scope 120. The firearm cover 100 may protect the firearm 102 from contaminants, such as rain, snow, dirt, etc. In some instances, the firearm 102 may be discharged when the firearm cover 100 is attached to the firearm 102. Similarly, the scope 120 may be used to aim the firearm 102 when the firearm cover 100 is attached to the firearm 102. In this manner, the firearm cover 100 may protect the firearm 102 from the environment but may not limit the operation of the firearm 102.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

I claim:

1. A firearm cover for attachment to a firearm with a scope mounted thereto, the firearm cover comprising:

a barrel cover;

a stock cover attached to the barrel cover wherein the barrel cover and the stock cover comprise a single unitary piece of material, wherein the stock cover comprises an open configuration and a closed configuration, wherein the stock cover comprises:

a butt cover comprising a plurality of butt flaps, wherein the plurality of butt flaps comprises a rear flap, atop flap, a first bottom flap, and a second bottom flap, wherein the top flap is disposed over the rear flap, the first bottom flap, and the second bottom flap and downward facing in the closed configuration, a fore-end cover comprising at least two fore-end flaps, wherein an outer fore-end flap of the at least two fore-end flaps is downward facing in the closed configuration, wherein the fore-end cover comprises a cutout portion to accommodate an action assembly and a trigger assembly of the firearm, wherein the action assembly and the trigger assembly of the firearm are operational to fire the firearm when the firearm cover is completely disposed about the firearm and all flaps are fastened together, wherein the fore-end cover comprises a cutout strap extending from one side of the fore-end cover to an opposite side of the fore-end cover across the cutout portion over the firearm and beneath the scope, and an opening formed between the first bottom flap and the second bottom flap for the attachment of a sling; and a rotatable hood attached to the stock cover, wherein the rotatable hood comprises a first configuration disposed about the scope and a second configuration rotated away from the scope.

2. The firearm cover of claim 1, wherein the rotatable hood completely covers the scope in the first configuration.

3. The firearm cover of claim 1, wherein the rotatable hood faces downward in the first configuration.

4. The firearm cover of claim 1, wherein the scope is operational for aiming when the rotatable hood is in the second configuration.

5. The firearm cover of claim 1, further comprising at least one coupling configured to secure the rotatable hood in the first configuration.

6. The firearm cover of claim 1, wherein the second bottom flap comprises a fastening strap configured to be attached to the fore-end cover.

7. The firearm cover of claim 1, wherein the barrel cover comprises a tubular member extending from the stock cover to a muzzle of the firearm.

8. The firearm cover of claim 7, wherein the barrel cover comprises an opening at the muzzle of the firearm.

* * * * *